US007137351B2

(12) United States Patent
Picou

(10) Patent No.: US 7,137,351 B2
(45) Date of Patent: Nov. 21, 2006

(54) FOLDING SEAT

(75) Inventor: Tony K. Picou, Houma, LA (US)

(73) Assignee: Retract Innovations, LLC, Houma, LA (US)

( * ) Notice: Subject to any disclaimer, the term of this patent is extended or adjusted under 35 U.S.C. 154(b) by 0 days.

(21) Appl. No.: 11/199,055

(22) Filed: Aug. 8, 2005

(65) Prior Publication Data

US 2006/0027158 A1 Feb. 9, 2006

Related U.S. Application Data

(60) Provisional application No. 60/600,000, filed on Aug. 9, 2004.

(51) Int. Cl.
*B63B 17/00* (2006.01)
*A47C 4/00* (2006.01)

(52) U.S. Cl. ..... 114/363; 297/16.2

(58) Field of Classification Search ..... 114/363; 297/16.1, 16.2, 440.1, 440.24, 463.2, 17
See application file for complete search history.

(56) References Cited

U.S. PATENT DOCUMENTS 506,255 A * 10/1893 Reutter ..... 248/155.2
582,338 A * 5/1897 Birdsall ..... 248/165
2,778,593 A * 1/1957 Stover ..... 248/170

FOREIGN PATENT DOCUMENTS

FR 2585548 A1 * 2/1987

* cited by examiner

*Primary Examiner*—Jesús D. Sotelo
(74) *Attorney, Agent, or Firm*—Ted M. Anthony

(57) ABSTRACT

A portable folding seat has a fabric seat supported in an open position by support rods and a rigid canister. In an open position, the canister functions as a pedestal for the seat and is removably affixed to a mounting surface. The folding seat may be folded into a retracted position such that the fabric seat is completely enclosed within the canister. A removable cap is provided to close the top opening of the canister when the folding boat seat is in the retracted position.

13 Claims, 5 Drawing Sheets

FOLDING SEAT

CROSS REFERENCES TO RELATED APPLICATIONS

This application claims the benefit of provisional patent application Ser. No. 60/600,000 filed Aug. 9, 2004.

FEDERALLY SPONSORED RESEARCH

Not Applicable

SEQUENCE LISTING OF PROGRAM

Not Applicable

BACKGROUND OF INVENTION

1. Field of Invention

The present invention relates to a folding seat. More particularly, the present invention relates to a portable, folding seat suitable for use on open-deck boats.

2. Description of Related Art

Seats of various types and configurations are well known in the art. Similarly, folding seats and chairs of various designs are also well known. On boats, such as open-deck boats used primarily for fishing and recreational purposes, boat chairs typically comprise a hard seat base and back rest structure, often covered with padding. Such seat structures are typically supported by a pedestal, and are rotatably mounted to the deck of a boat. A common means of mounting said pedestal to the boat deck comprises a rod extending vertically downward from the seat structure which is received within a mounting bracket on the deck of the boat.

On boats designed primarily for fishing, especially vessels commonly referred to as "bass boats," seats are positioned toward the bow of the boat for use during fishing. However, when the boat is underway, standard seats may obstruct the visibility of the boat driver. While some existing seats are removable from their deck mounting, frequently there is no safe or secure position in which to stow them while the boat is underway.

During the fishing process, it is often desirable to move about the deck of the boat. The large size of existing boat seats of the prior art reduce available deck space and may make such movement inconvenient or even dangerous. Moreover, due to the nature of existing boat seats, such seats are typically exposed to sunlight and weather for extended periods of time. Such exposure can damage and significantly reduce the usable life of such seats.

Open-deck fishing boats, as described herein, are often used by fishermen who compete in fishing tournaments and/or other events. Sponsors and/or other parties frequently seek to achieve advertising exposure by prominently displaying their names, logos or marks during such events, or at other similar times. One of the most prominent features of a fishing boat upon which names, logos and/or marks can be displayed is the seat. However, materials and construction of such prior art seats do not readily lend themselves to such display.

SUMMARY OF THE INVENTION

The folding seat of the present invention provides a pliable seat/support base and seat back which may be completely retracted into a rigid canister for storage. A rod extends vertically from the base of such canister, and may be rotably mounted to a desired surface. For example, the seat of the present invention can be rotatably mounted to the deck of a boat in the same manner as boat seats of the prior art. As such, the rigid canister serves as a pedestal for the seat of the present invention while the seat is in use. The folding seat is free to rotate about the longitudinal axis of said rigid canister. During the period that the boat is underway, or at such other times as may be desirable, the canister, with the folding seat retracted therein, may remain mounted to the boat deck without obstructing the visibility of a boat driver. Alternatively, the retracted seat of the present invention can be removed from the mounting bracket and securely stored.

A removable cap can be secured to one end of the canister when the folding seat is retracted to protect the fabric of the seat from sunlight, weather and/or other environmental factors. Further, the seat of the present invention provides a surface for prominently displaying a name, logo, mark or other desired image.

It is therefore an object of the present invention to provide a folding seat which can be retracted into a rigid canister.

It is a further object of the present invention to provide a folding seat which, when used on a boat and retracted into said rigid canister, does not obstruct the visibility of a boat driver.

It is a further object of the present invention to provide a folding seat which is compact and can be easily stowed, such as in a storage compartment of a boat.

It is a further object of the present invention to provide a folding seat employing a pliable fabric which provides a visible surface for prominently displaying a name, logo, mark or other desired image. Alternatively, the compact size of the canister allows it to be removed and easily stowed in a storage compartment of the boat.

DETAILED DESCRIPTION OF A PREFERRED EMBODIMENT

Figure 1:
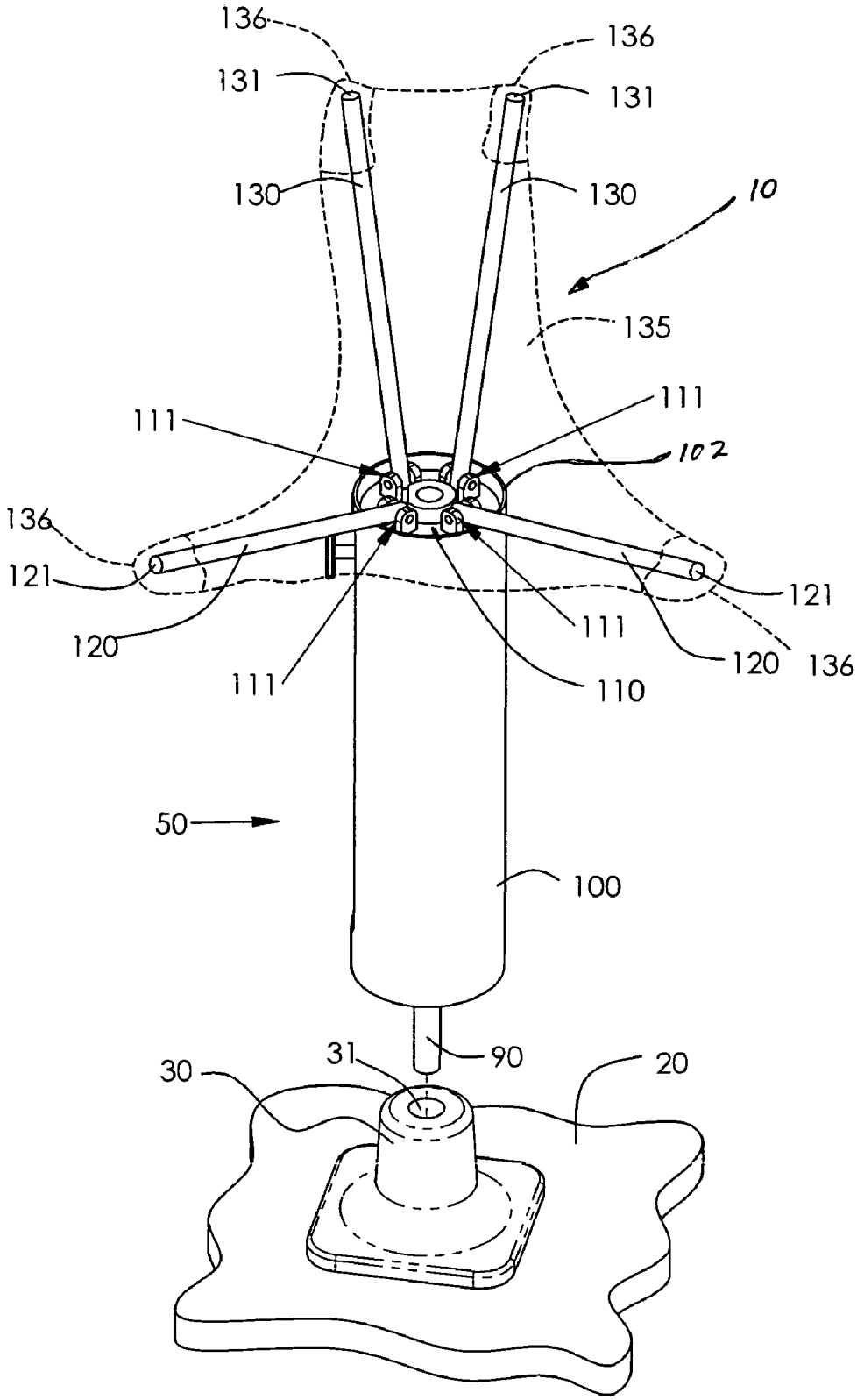
FIG. 1 depicts a perspective view of the folding seat of the present invention in a substantially open position.

FIG. 1 depicts a perspective view of folding seat 10, a portion of boat deck 20, and mounting bracket 30. Boat deck 20 and mounting bracket 30 are not a part of the present invention and are shown in FIG. 1 only for descriptive purposes. Mounting bracket 30, as shown, represents any of several designs of similar mounting brackets currently in use. Mounting bracket 30 is rigidly attached to boat deck 20.

Folding seat 10 is mounted to boat deck 20 utilizing mounting bracket 30. Folding seat 10 further comprises pedestal assembly 50. Mounting rod 90 extends downward from the base of pedestal assembly 50 and is slidably and rotatably received within bore 31 of mounting bracket 30; however, in FIG. 1, folding seat 10 is shown disposed above mounting bracket 30 as in an exploded view.

Folding seat 10 has an open position as depicted in FIG. 1. In such open position, folding seat 10 is configured to receive and support a user, ideally in a sitting position. Pedestal assembly 50 comprises rigid, substantially cylindrical canister 100 and sliding plate 110. Sliding plate 110 is slidably disposed within rigid canister 100. Sliding plate 110 and rigid canister 100 are coaxially aligned. In such open position, sliding plate 110 is disposed near upper surface 102 of rigid canister 100. Seat base support rods 120 and seat back support rods 130 are pivotally attached to the upper surface of sliding plate 110 via clevis mounts 111. (FIG. 3 better depicts the angles of seat support rods 120 and seat back support rods 130 projected in a side view in such open position.)

Still referring to FIG. 1, fabric seat 135 is suspended in a conventional "cup-like" configuration by seat base support rods 120 and seat back support rods 130. Corners 136 of fabric seat 135 are attached to distal ends 121 of seat base support rods 120 and distal ends 131 of seat back support rods 130. In the preferred embodiment, such distal ends 121 and 131 are received within pockets on fabric seat 135; however, it is possible that other attachment means could be used for this purpose.

Figure 2:
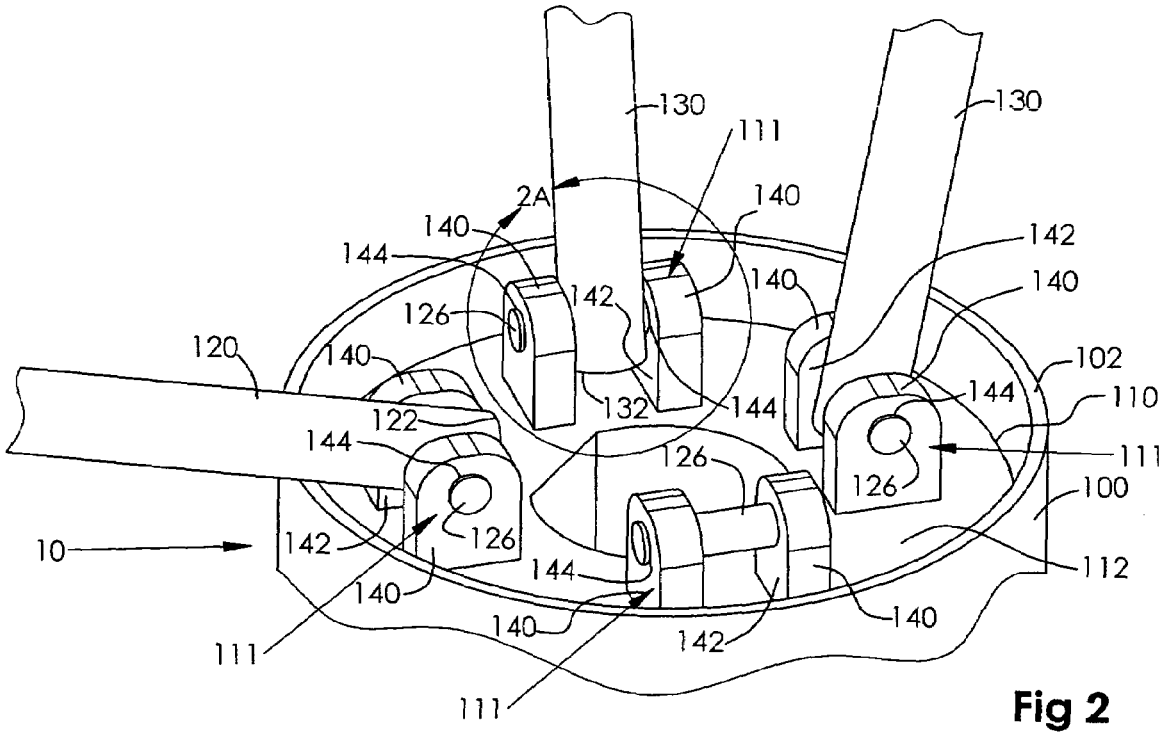
FIG. 2 depicts a detail perspective view of sliding plate and seat support rods of the present invention with seat fabric removed.
Figure 2A:
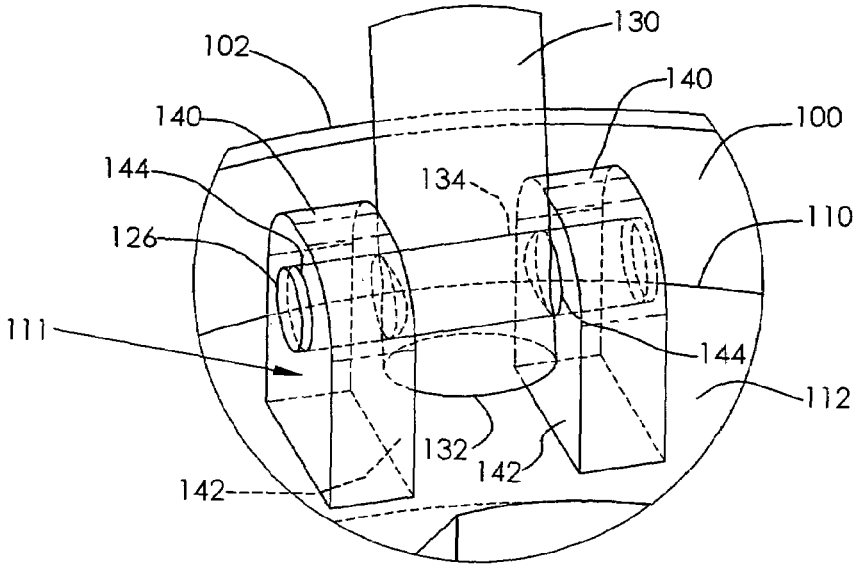
FIG. 2A depicts an enlarged detail view of a portion of the structure depicted in FIG. 2.

FIG. 2 and FIG. 2A depict detail perspective views of folding seat 10 of the present invention. In FIG. 2 and FIG. 2A, fabric seat 135, and one seat support rod 120 are removed from view for illustration purposes. Sliding plate 110 includes a plurality clevis brackets 111 on the upper surface 112 of sliding plate 110. Each clevis bracket 111 comprises two vertical plates 140 extending upward from the upper surface 112 of sliding plate 110.

Each vertical plate 140 of each clevis bracket 111 has a medial face 142, and a horizontal through-hole 144. For each clevis bracket 111, medial faces 142 of the two vertical plates 140 of said clevis bracket 111 are parallel and are disposed from each other symmetrically about a radial center-line by a distance which is slightly greater than the width of seat base support rods 120 and seat back support rods 130. Further, for each clevis bracket 111, through-holes 144 of each vertical plate 140 are coaxial and aligned with one another.

Referring specifically to FIG. 2A, seat back support rods 130 each have a transverse hole 134 near their proximal ends 132. Transverse hole 134 of one seat back support rod 130 is seen in FIG. 2A. Similarly, seat support rods 120 have transverse holes 124, substantially similar to transverse holes 134 of seat back support rods 130, near their proximal ends 122.

With particular reference to FIG. 2A, end 132 of a first seat back support rod 130 is disposed between the vertical plates 140 of a first clevis bracket 111 such that transverse hole 134 of first seat back support rod 130 is aligned with and coaxial to horizontal through-holes 144 of vertical plates 140 of said clevis bracket 111. A first hinge pin 126 is disposed within aligned through-holes 144 of vertical plates 140 of said clevis bracket 111, as well as transverse hole 134 of said seat back support rod 130. As such, seat back support rod 130 is pivotally attached to upper surface 112 of sliding plate 110 by pin 126 using clevis bracket 111.

In a similar manner, proximal ends 122 of first and second seat base support rods 120 are disposed between vertical plates 140 of clevis brackets 111, and are pivotally attached thereto by pins 126. As such, as each seat base support rod 120 and each seat back support rod 130 pivot about their respective pin 126, said seat base support rods 120 and seat back support rods 130 sweep within vertical, radial, orthogonal planes. Downward travel of seat base support rods 120 about pin 126 is limited by contact between seat support rods 120 and top surface 102 of rigid canister 100.

Figure 3:
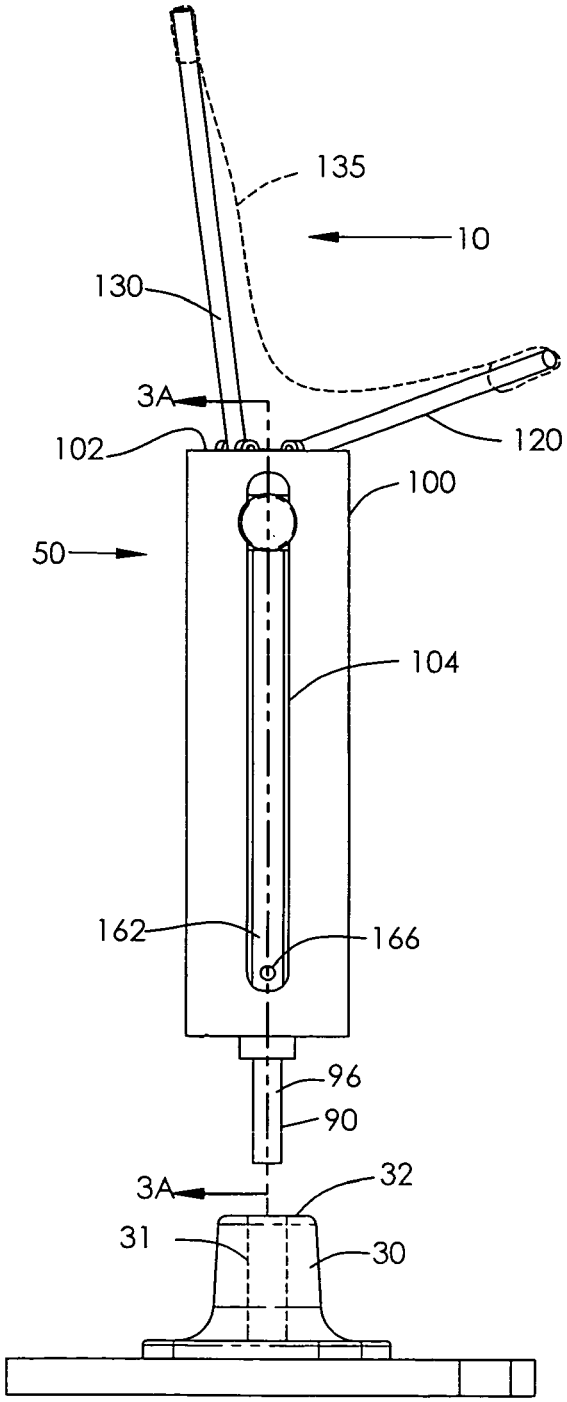
FIG. 3 depicts a side view of the folding seat of the present invention in a substantially open position.

FIG. 3 depicts a side view of folding seat 10 of the present invention, including pedestal assembly 50. Relative angles of seat support rods 120 and seat back support rods 130 projected onto the vertical plane of this view, and the "cup-like" shape of fabric seat 135 (described above) are depicted in this view of the present invention.

Figure 3A:
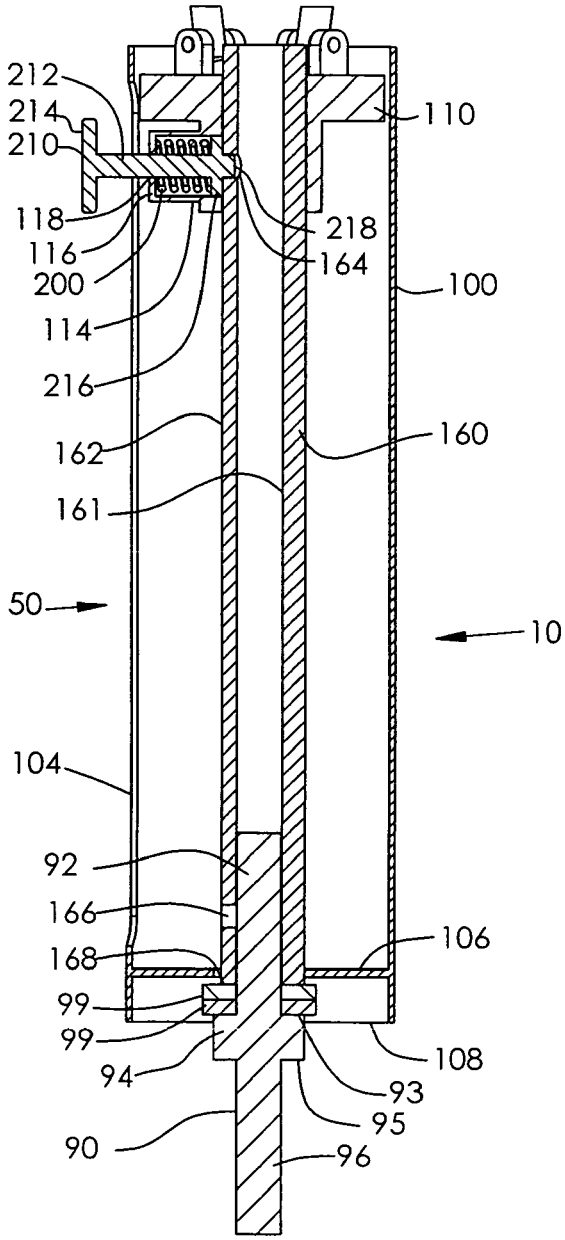
FIG. 3A depicts a side section view of the folding seat of the present invention in a substantially open position.

Rigid canister 100 has substantially vertical slot 104 which extends from a point near the base of canister 100 to a point slightly below top surface 102 of rigid canister 100. FIG. 3A depicts a side section view of pedestal assembly 50. Pedestal assembly 50 comprises rigid canister 100, sliding plate 110, locking pin 210, coil spring 200 and vertical support tube 160. Rigid canister 100 has bottom plate 106 disposed above the base of said canister 100. Vertical support tube 160 is a substantially vertical tube having a longitudinal flat surface 162. Flat surface 162 has a radial upper hole 164 and a radial lower hole 166. (Flat surface 162 and lower hole 166 of vertical support tube 160 are also seen in FIG. 3.) Bottom 168 of vertical support tube 160 extends downward through bottom plate 106 of rigid canister 100. In the preferred embodiment, vertical support tube 160 is rigidly attached to bottom plate 106 of canister 100.

In the preferred embodiment, mounting rod 90 is substantially cylindrical and has an upper diameter 92, a middle diameter 94 and a lower diameter 96. Lower diameter 96 of mounting rod 90 can be slidably and rotatably received within hole 31 of mounting bracket 30 as described earlier and as seen in FIG. 1 and FIG. 3. Lower diameter 96 of mounting rod 90 is suitably long so as to engage substantially the entire length of hole 31 of mounting bracket 30. Upper diameter 92 of mounting rod 90 fits slidably and rotatably within inside diameter 161 of vertical support tube 160. Upper diameter 92 of mounting rod 90 is sufficiently long such that typical side forces or moments applied to vertical support tube 160 are transmitted to upper diameter 92 of mounting rod 90 without inducing excessive contact stresses within upper diameter 92 of mounting rod 90 or within inside diameter 161 of vertical support tube 160.

In the preferred embodiment, middle diameter 94 of mounting rod 90 is relatively short and is larger than lower diameter 96 and upper diameter 92 of mounting rod 90. As such, middle diameter 94 defines an upper shoulder 93 and a lower shoulder 95. In the preferred embodiment, at least two bearing washers 99 are disposed coaxially about upper diameter 92 of mounting rod 90 between upper shoulder 93 of middle diameter 94 and bottom surface 168 of vertical support tube 160. Bearing washers 99 are ideally constructed of a material with high lubricity (such as, for example, nylon), to reduce rotational friction between bottom surface 168 of vertical support tube 160 and upper shoulder 93 of middle diameter 94. Lower shoulder 95 of middle diameter 94 contacts upper surface 32 of mounting pad 30. As such, downward forces, namely the weight of a user, applied to vertical support tube 160 are transmitted from bottom surface 168 of vertical support tube 160, through bearing washers, 99, through middle diameter 94 of mounting rod 90 to top surface 32 of mounting bracket 30.

Referring to FIG. 3A, sliding plate 110 comprises spring housing 114 which extends radially outward from sliding plate 110. Spring housing 114 has end cap 116. End cap 116 has central hole 118. Locking pin 210 has handle 214, shaft 212, flange 216 and boss 218. Locking pin 210 is coaxially disposed relative to spring housing 114. Shaft 212 of locking pin 210 is slidably received within hole 118 of end cap 116 of spring housing 114. Flange 216 of locking pin 210 is also slidably received within spring housing 114. Spring 200 is disposed within spring housing 114 between end cap 116 of spring housing 114 and flange 216 of locking pin 210. Spring 200 exerts an inward biasing force against flange 216 of locking pin 212.

In an open position, sliding plate 110 is disposed such that boss 218 of locking pin 212 is aligned with upper hole 164 in vertical support tube 160. As such, in said open position, spring 200 biases boss 218 of locking pin 212 into upper hole 164 of vertical support tube 160, thereby restraining sliding plate 110 from sliding vertically along the length of vertical support tube 160. Shaft 212 of locking pin 210 extends radially outward through slot 104 of rigid canister 100. Handle 214 is disposed at the outer end of shaft 212 of locking pin 210. In the preferred embodiment, handle 214 is a flat, circular plate which may be grasped by a user's fingers to pull locking pin 210 radially outward, thereby compressing spring 200 and disengaging boss 218 of locking pin 210 from upper hole 164 of vertical support tube 160 and, thereby, permitting sliding plate 110 to travel along the length of vertical support tube 160.

Figure 4:
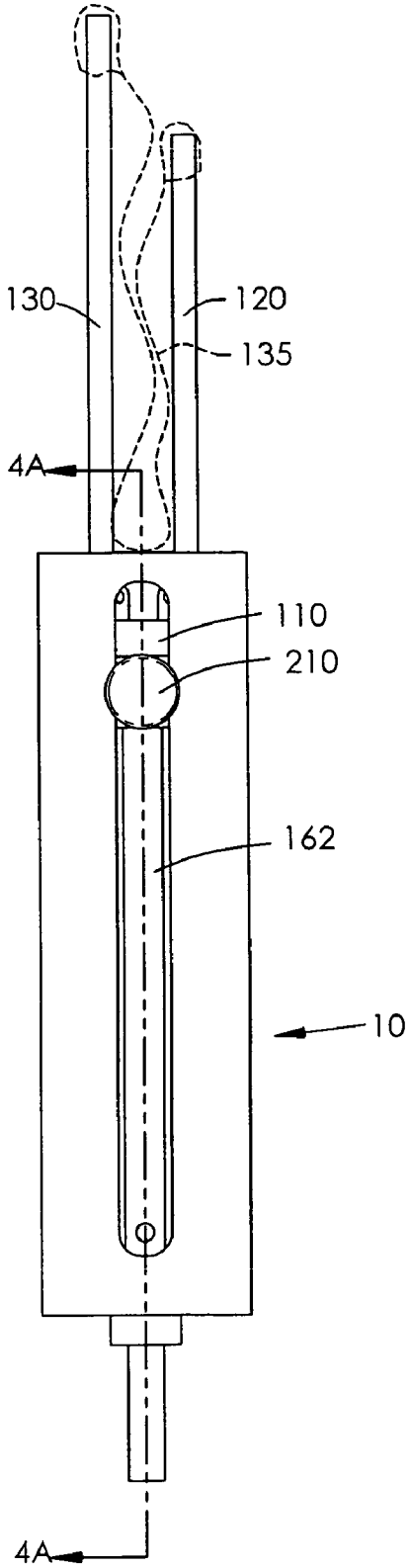
FIG. 4 depicts a side view of the folding seat of the present invention in a partially collapsed position.
Figure 4A:
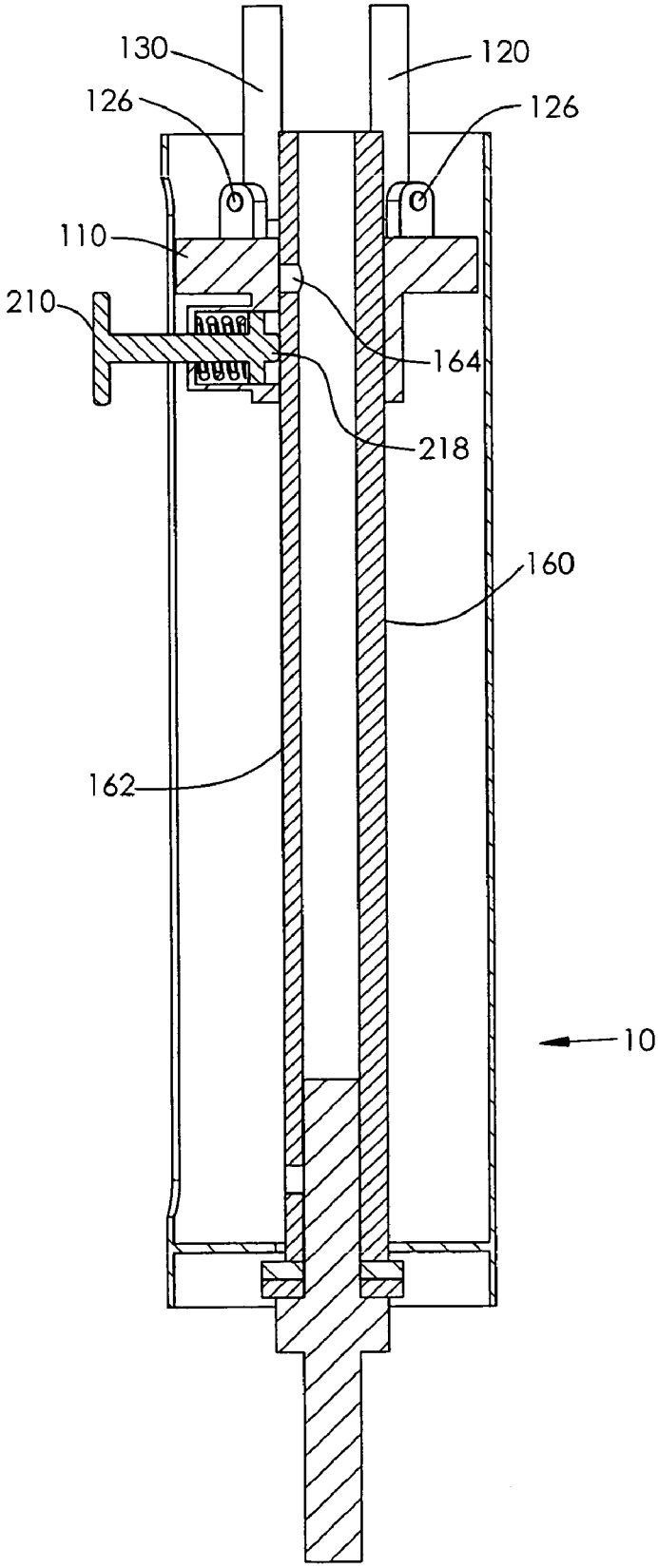
FIG. 4A depicts a side section view of the folding seat of the present invention in a partially collapsed position.

Referring to FIG. 4 and FIG. 4A, folding seat 10 also has a partially collapsed or "interim" position. In such interim position, seat base support rods 120 and seat back support rods 130 are rotated upward about pins 126, such that the longitudinal axes of said seat base support rods 120 and seat back support rods 130 are oriented in a substantially vertical position. Fabric seat 135 is folded around seat base support rods 120 and seat back support rods 130. Referring specifically to FIG. 4A, locking pin 210 is retracted from upper hole 164 of vertical support tube 160. Sliding plate 110 is disposed slightly downward relative to its location in the open position, such that boss 218 of locking pin 210 is not coaxial to upper hole 164 of vertical support tube 160.

Figure 5:
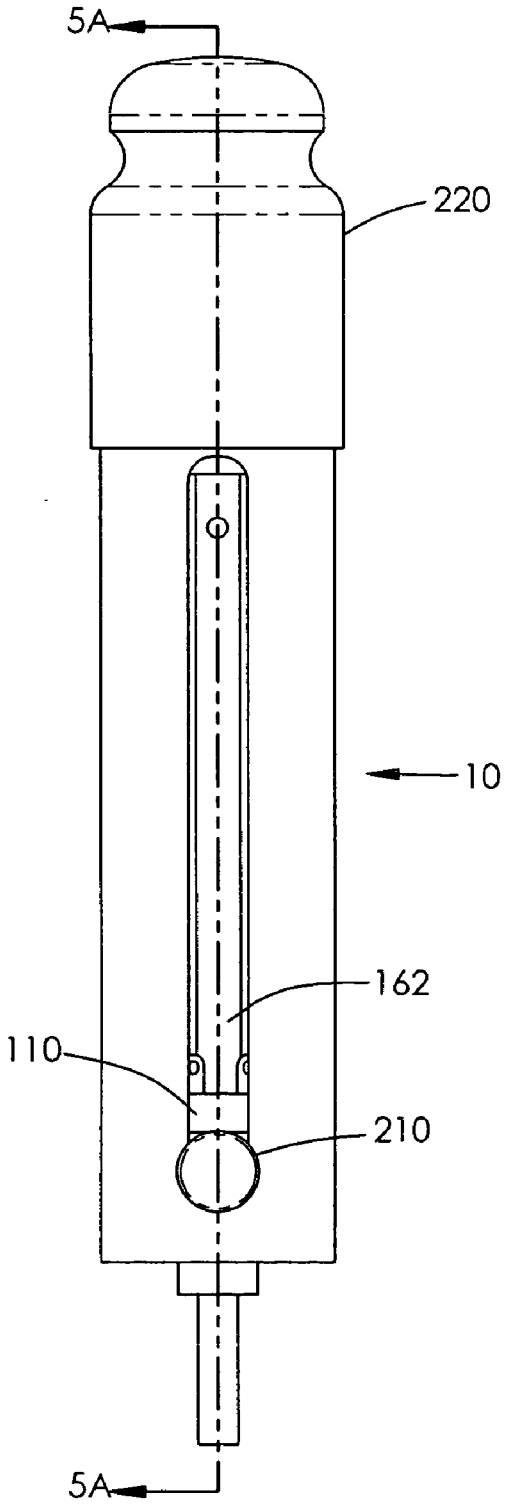
FIG. 5 depicts a side view of the folding seat of the present invention in a substantially retracted position.
Figure 5A:
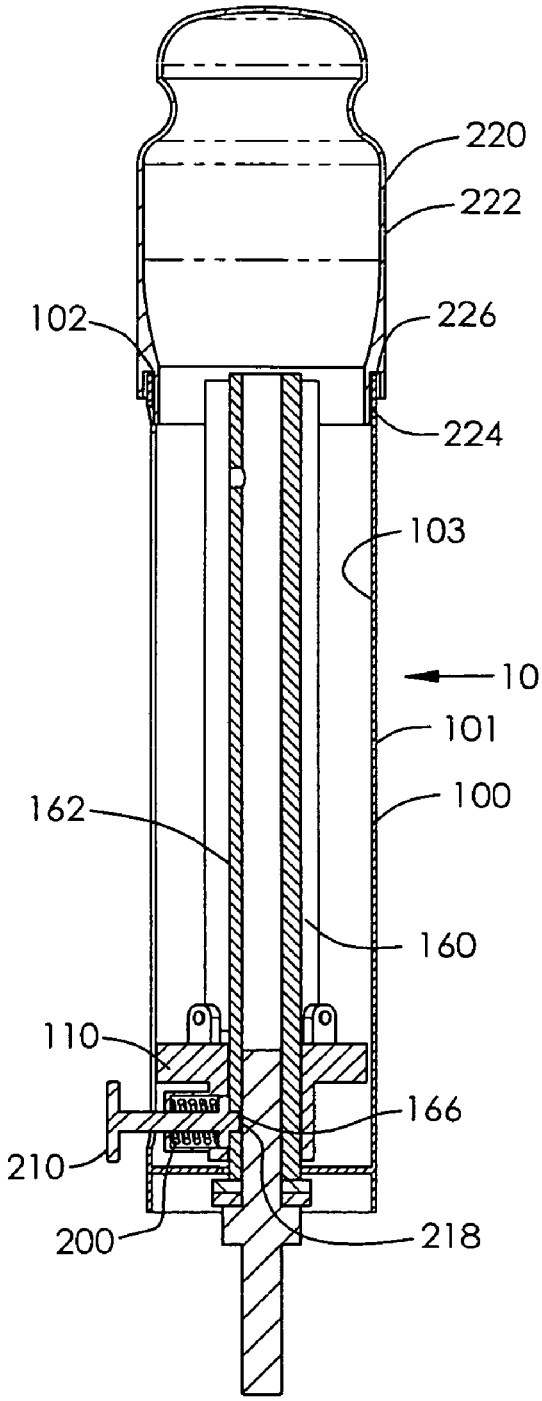
FIG. 5A depicts a side section view of the folding seat of the present invention in a substantially retracted position.

Referring to FIG. 5 and FIG. 5A, folding seat 10 further has a retracted position. In such retracted position, sliding plate 110 is disposed downward within rigid canister 100 such that boss 218 of locking pin 210 is coaxial to lower hole 166 of vertical support tube 160. As such, boss 218 of locking pin 210 is biased into lower hole 166 by spring 200, and sliding plate 110 is thereby restrained from sliding vertically along the length of vertical support tube 160.

Folding seat 10 further comprises removable end cap 220. In the preferred embodiment, cap 220 is hollow and has large diameter 222 and small diameter 224. Small diameter 224 is disposed below large diameter 222. Large diameter 222 has shoulder 226 between large diameter 222 and small diameter 224. Large diameter 222 is slightly larger than outside diameter 101 of rigid canister 100. If desired, small diameter 224 has a tapered end, and is approximately equal to inside diameter 103 of canister 100 such that small diameter 224 of cap 220 fits slidably and snugly within rigid canister 100. Shoulder 226 of large diameter 222 of cap 220 engages top surface 102 of canister 100. In this position, folding seat 10 is completely contained within canister 100 and is covered by cap 220.

In operation, folding seat 10 is transfigured from retracted position to open position by removing cap 220 from canister 100. Locking pin 210 is manually retracted from lower hole 166 of vertical support tube 160, and sliding plate 110 is lifted vertically until boss 218 of locking pin 210 is oriented adjacent and coaxial to upper hole 164 of vertical support tube 160. In this position, boss 218 of locking pin 210 is biased into upper hole 164 of vertical support tube 160 by spring 200, and sliding plate 110 is thereby restrained from sliding along the length of vertical support tube 160. Seat base support rods 120 and seat back support rods 130 are rotated about pins 126 such that fabric seat 135 is suspended in open position as described above and as shown in FIG. 1 and FIG. 3.

Similarly, folding seat 10 is transfigured from open position to retracted position by rotating seat base support rods 120 and seat back support rods 130 about pins 126 such that seat base support rods 120 and seat back support rods 130 are in a substantially vertical position. Fabric seat 135 is affixed to such seat base support rods 120 and seat back support rods 130. Locking pin 210 is manually retracted from upper hole 164 of vertical support tube 160, and sliding plate 110 is directed downward until boss 218 of locking pin 210 is coaxial to lower hole 166 of vertical support tube 160. As such, boss 218 of locking pin 210 is biased into lower hole 166 of vertical support tube 160 by spring 200, and sliding plate 110 is thereby restrained from sliding vertically along the length of vertical support tube 160. Cap 220 is installed on rigid canister 100. In a retracted position, folding seat 10 may be removed from mounting bracket 30 and placed in a convenient and/or secure storage location.

While the above description contains many specifics, these should not be construed as limitations of the scope of the present invention. Although the preferred embodiment of the present invention is described in the context of a boat mounting, it is to be observed that the folding chair of the present invention can be beneficially employed in any number of other environments. Numerous alternative embodiments are contemplated, such as a lower support means whereby folding seat 10 may be placed on any flat surface and the addition of arm rests to the fabric seat. Further, the canister and pedestal assembly may be constructed in shapes other than the cylinder described herein; for example, the canister and pedestal assembly may be oval, square, rectangular or other shape. Also, the spring-biased locking pin described herein may be replaced with a threaded set-screw locking assembly. The cap may be threaded onto the canister rather than inserted, and said apparatus may also include a mounting device for an optional umbrella or other accessory.

Whereas the invention is herein described with respect to a preferred embodiment, it should be realized that the above described and other various changes may be made without departing from the essential contributions to the art made by teachings hereof.

What is claimed:

1. A folding seat comprising:

a. a rigid canister having a top, a bottom and a bore;

b. a collapsible seat disposed at the top of said canister, wherein said seat comprises a substantially horizontal base section and a substantially vertical back section; and c. means for retracting said seat within the bore of said canister.

2. A folding seat comprising:

a. a canister;

b. an elongate member disposed within said canister;

c. a plate slidably disposed on said elongate member;

d. a plurality of rods pivotally attached to said plate;

e. a flexible element attached to said rods; and f. means for locking said plate in position along said elongate member.

3. The folding seat of claim 2, wherein said canister is rigid.

4. The folding seat of claim 2, wherein said canister is substantially cylindrical.

5. The folding seat of claim 2, further comprising a cap removably received on said canister.

6. The folding seat of claim 2, wherein said flexible element is fabric.

7. The folding seat of claim 2, wherein said means for locking said plate comprises:

a. at least one indentation in said elongate member;

b. a hole disposed in said plate, wherein said hole is oriented substantially perpendicular to the longitudinal axis of said elongate member;

c. a pin slidably received within said hole; and d. a spring biasing said pin toward said at least one indentation in said elongate member.

8. A folding seat comprising:

a. a substantially cylindrical canister having a first end, second end, a length, and an opening at said first end;

b. an elongate member disposed within said canister, wherein said elongate member extends substantially along the entire length of said canister;

c. a plate slidably disposed on said elongate member;

d. a plurality of clevis brackets attached to said plate;

e. a plurality of rods pivotally attached to said clevis brackets;

f. a flexible element attached to said rods; and g. means for locking said plate in position along said elongate member.

9. The folding seat of claim 8, wherein said canister is rigid.

10. The folding seat of claim 8, wherein said canister is substantially cylindrical.

11. The folding seat of claim 8, further comprising a cap removably received on said canister.

12. The folding seat of claim 8, further comprising a post extending from the second end of said canister.

13. The folding seat of claim 8, wherein said means for locking said plate comprises:

a. at least one indentation in said elongate member;

b. a hole disposed in said plate, wherein said hole is oriented substantially perpendicular to the longitudinal axis of said elongate member;

c. a pin slidably received within said hole; and d. a spring biasing said pin toward said at least one indentation in said elongate member.

* * * * *